US012130020B2

(12) United States Patent
DeGraaf et al.

(10) Patent No.: US 12,130,020 B2
(45) Date of Patent: Oct. 29, 2024

(54) APPARATUS, SYSTEM AND METHOD FOR MODULAR MANUFACTURE OF COOKING APPLIANCES

(71) Applicant: JABIL INC., St. Petersburg, FL (US)

(72) Inventors: Gerald DeGraaf, St. Petersburg, FL (US); Jordan DeGraaf, St. Petersburg, FL (US)

(73) Assignee: JABIL INC.

( * ) Notice: Subject to any disclaimer, the term of this patent is extended or adjusted under 35 U.S.C. 154(b) by 706 days.

(21) Appl. No.: 17/386,227

(22) Filed: Jul. 27, 2021

(65) Prior Publication Data

US 2022/0018547 A1 Jan. 20, 2022

Related U.S. Application Data

(63) Continuation-in-part of application No. 17/417,404, filed as application No. PCT/US2020/014038 on Jan. 17, 2020.

(Continued)

(51) Int. Cl.
*F24C 15/00* (2006.01)
*F24C 15/02* (2006.01)

(Continued)

(52) U.S. Cl.
CPC ..... *F24C 15/08* (2013.01); *F24C 15/023* (2013.01); *F24C 15/06* (2013.01); *F24C 15/10* (2013.01)

(58) Field of Classification Search
CPC ..... F24C 15/08; F24C 15/023; F24C 15/06; F24C 15/10

(Continued)

(56) References Cited

U.S. PATENT DOCUMENTS 1,016,565 A * 2/1912 Huenefeld ..... F24C 15/08 126/275 R
4,869,231 A * 9/1989 Rice ..... F24C 15/10 126/39 B (Continued)

FOREIGN PATENT DOCUMENTS

CN 1966816 5/2007
CN 101878496 11/2010

(Continued)

OTHER PUBLICATIONS

International Search Report and Written Opinion issued on Jul. 23, 2020 in PCT/US2020/014038.

(Continued)

*Primary Examiner* — Avinash A Savani
(74) *Attorney, Agent, or Firm* — Riverside Law LLP

(57) ABSTRACT

An apparatus, system and method for a manufactured cooking appliance. The apparatus, system and method may include: a generic device shell comprising at least a power supplying wire harness and a plurality of female latching points on a top and a front thereof; a folding module comprising a cooktop and, hinged to the cooktop, an oven front comprising at least an oven door fittedly associated with a frame and having a door hinge connected to the over door and passing through the frame; and a plurality of male latches associated with the folding module, including at least one male latch associated with the portion of the door hinge that passes through the frame, each capable of latching into a corresponded one of the plurality of female latching points so as to, upon the latching, form a completed one of the manufactured stove.

20 Claims, 16 Drawing Sheets

Related U.S. Application Data

(60) Provisional application No. 62/793,624, filed on Jan. 17, 2019.

(51) Int. Cl.
*F24C 15/06* (2006.01)
*F24C 15/08* (2006.01)
*F24C 15/10* (2006.01)

(58) Field of Classification Search
USPC ..... 126/1 R
See application file for complete search history.

(56) References Cited

U.S. PATENT DOCUMENTS

| | | | | |
|---|---|---|---|---|
| 5,215,074 | A * | 6/1993 | Wilson | F24C 15/10 126/39 B |
| 5,375,587 | A * | 12/1994 | Ward | F24C 15/026 126/200 |
| 6,041,773 | A * | 3/2000 | Rosenquist | F24C 1/16 126/41 R |
| 2006/0097546 | A1 | 5/2006 | Lynam | |
| 2007/0246967 | A1 | 10/2007 | Lynam | |
| 2007/0267401 | A1 | 11/2007 | Collene | |
| 2008/0185372 | A1 | 8/2008 | Elkasevic | |
| 2008/0268330 | A1 | 10/2008 | Hansen | |
| 2014/0158676 | A1 | 6/2014 | Phillips | |
| 2014/0319122 | A1* | 10/2014 | Ruperee | F24C 15/108 219/453.11 |
| 2017/0009391 | A1 | 1/2017 | Fu et al. | |
| 2020/0408415 | A1* | 12/2020 | Jarvis | F24C 15/108 |
| 2022/0018547 | A1 | 1/2022 | DeGraaf | |

FOREIGN PATENT DOCUMENTS

| | | | |
|---|---|---|---|
| CN | 104711832 | | 6/2015 |
| CN | 108729117 | | 11/2018 |
| DE | 4139588 | | 6/1992 |
| EP | 0943721 | | 9/1999 |
| KR | 100641433 | | 11/2006 |
| KR | 1020070075543 | A | 7/2007 |
| KR | 20130044609 | | 5/2013 |
| KR | 101330243 | B1 | 11/2013 |
| WO | 2004070278 | | 8/2004 |
| WO | 2010142556 | A1 | 12/2010 |
| WO | 2011007226 | A1 | 1/2011 |

OTHER PUBLICATIONS

International Preliminary Report on Patentability, dated Jul. 20, 2021 in PCT/US2020/014038.

Communication pursuant to Article 94(3) issued in App. No. EP20741950, dated Jan. 3, 2024, 7 pages.

Mekonnen Wassie Shimelis, "Modularization of a washing machine and study its potential in implementing multiple life-cycles", (Oct. 31, 2016), pp. 1-53, URL: https://www.diva-portal.org/smash/get/diva2:1071112/FULLTEXT01.pdf, (Jan. 26, 2022), XP055884033.

* cited by examiner

APPARATUS, SYSTEM AND METHOD FOR MODULAR MANUFACTURE OF COOKING APPLIANCES

CROSS-REFERENCE TO RELATED APPLICATIONS

The present application is a Continuation-In-Part Application to U.S. patent application Ser. No. 17/417,404, filed Jun. 23, 2021, entitled: "Apparatus, System and Method for Modular Manufacture", which claims the benefit of priority to International Application No. PCT/US2020/014038, filed Jan. 17, 2020, entitled: "Apparatus, System and Method for Modular Manufacture", which claims the benefit of priority to U.S. Provisional Application No. 62/793,624, filed Jan. 17, 2019, entitled: "Apparatus, System and Method for Modular Manufacture," the entirety of each of which is incorporated herein by reference as if set forth in its respective entirety.

BACKGROUND

Field of the Disclosure

The present disclosure relates to manufacturing, and, more specifically, to an apparatus, system and method for modular manufacture of cooking appliances.

Description of the Background

In presently known manufacturing operations, such as may be typical of large devices, such as appliances, ever increasing numbers of components and component related aspects are being added to the manufactured devices in order to provide functionality in line with modern expectations. For example, with the advent of the internet of things (IoT), it is often not only expected that modern devices have highly intuitive user interfaces, which additionally include broad applications and variation functions available via the user interface, but additionally that the device is capable of communication, such as simple communications wherein device errors are indicated, logged, and transmitted, or such as more complex communications. Both of these types of communication may occur over wireless connection, such as to or via home networks to brand centers, and the like. Moreover, it is expected that these increasingly capable devices not only provide the foregoing extensive functionality, but further that these devices operate more consistently and well, and last longer.

Unfortunately, the offering of ever increasing numbers of features, communicative aspects, and so on, along with preferences by manufacturers for increased production rate, yields, etc., such that manufacturer profitability be maintained, does not comport with typical device manufacturing technologies. Indeed, most devices are largely manufactured by hand, not dissimilarly to the way those devices were manufactured long before the availability of graphical user interfaces, device lighting, device communications, and the like.

For example, most devices include a plurality of wiring harnesses, each with numerous fasteners in various locations throughout a device, that transmit signals and power to and from a number of circuit boards, electrical elements, and the like (hereinafter, collectively "components"). In order to provide adequate space for the functional aspects of the device, it is typical that these numerous fasteners, wiring, components, and the like must be placed at awkward positions throughout the device. Thus, manual installation of all of these aspects may be awkward and difficult, and such installations are further highly repetitive and may require varying levels of strength, such as to make connections and fasten aspects. These variations may even occur as between the same components on different devices, in part due to engineering tolerances present in manufacturing the shell of a device.

The repetitive and time consuming nature of such installations of wiring, wiring harnesses, fasteners, and components within a device, at difficult angles and using varying strength, often leads to workplace injuries. Such manufacturing complexities and workplace injuries may slow production times, thereby increasing manufacturing cost.

Yet further, the manufacturing complexity discussed herein requires that substantial storage and floor space be dedicated to installation stages for in-process inventory, and to the aspects that must be installed into the in-process inventory. Moreover, for large "box" shaped appliances, such as certain cooking appliances, a "base cabinet" need include little other than a light and wiring for power, but nevertheless, these large cabinets must be kept in inventory and must be included in the manufacturing process along with the "smart" hardware and software elements, and must also be stored following manufacture and prior to sale. This need for storage and processing space further limits throughput in the manufacturing line, and limits the ability to store inventory after manufacture and at retail outlets.

More specifically, a typical manufacturing line in the known art requires that the device, such as the large appliance being manufactured, be transported from station to station to enable manual installation of unique components at each new station. As such, each station requires a specialized laborer who does repeated installations of the same or similar components over the course of a work period. Needless to say, at least the aforementioned throughput limitations imparted by in-process inventory limit the availability of device flow from station to station, and the repetitive aspects required of laborers create job dissatisfaction and repetitive work injuries, as mentioned above. Yet further, the foregoing aspects, in combination, decrease both throughput and yield, as discussed above.

SUMMARY

The disclosure is of and includes at least an apparatus, system and method for a manufactured range or oven. The apparatus, system and method may include a generic device shell capable of providing at least a back, bottom and sides of the manufactured range or oven, wherein the generic device shell comprises at least a power supplying wire harness and a plurality of female latching points on a top and a front thereof; a folding module comprising a cooktop suitable for forming a top of the manufactured stove and, hinged to the cooktop, an oven front suitable for forming a front of the manufactured stove, the oven front comprising at least an oven door fittedly associated with a frame and having a door hinge connected to the over door and passing through the frame; and a plurality of male latches associated with the folding module, including at least one male latch associated with the portion of the door hinge that passes through the frame, each capable of latching into a corresponded one of the plurality of female latching points so as to, upon the latching, form a completed one of the manufactured stove.

The apparatus, system and method may additionally be for a manufactured oven, and may include: a generic device shell capable of providing at least a back, top, bottom and sides of the manufactured oven, wherein the generic device shell comprises at least a power supplying wire harness and a plurality of female latching points on a front thereof; a modular oven front suitable for forming a front of the manufactured oven, the modular oven front comprising at least an oven door fittedly associated with a frame and having a door hinge connected to the over door and passing through the frame; and a plurality of male latches associated with the modular over front, including at least one male latch associated with the portion of the door hinge that passes through the frame, each capable of latching into a corresponded one of the plurality of female latching points so as to, upon the latching, form a completed one of the manufactured oven.

BRIEF DESCRIPTION OF THE DRAWINGS

The disclosed non-limiting embodiments are discussed in relation to the drawings appended hereto and forming part hereof, wherein like numerals indicate like elements, and in which.

DETAILED DESCRIPTION

Figure 1:
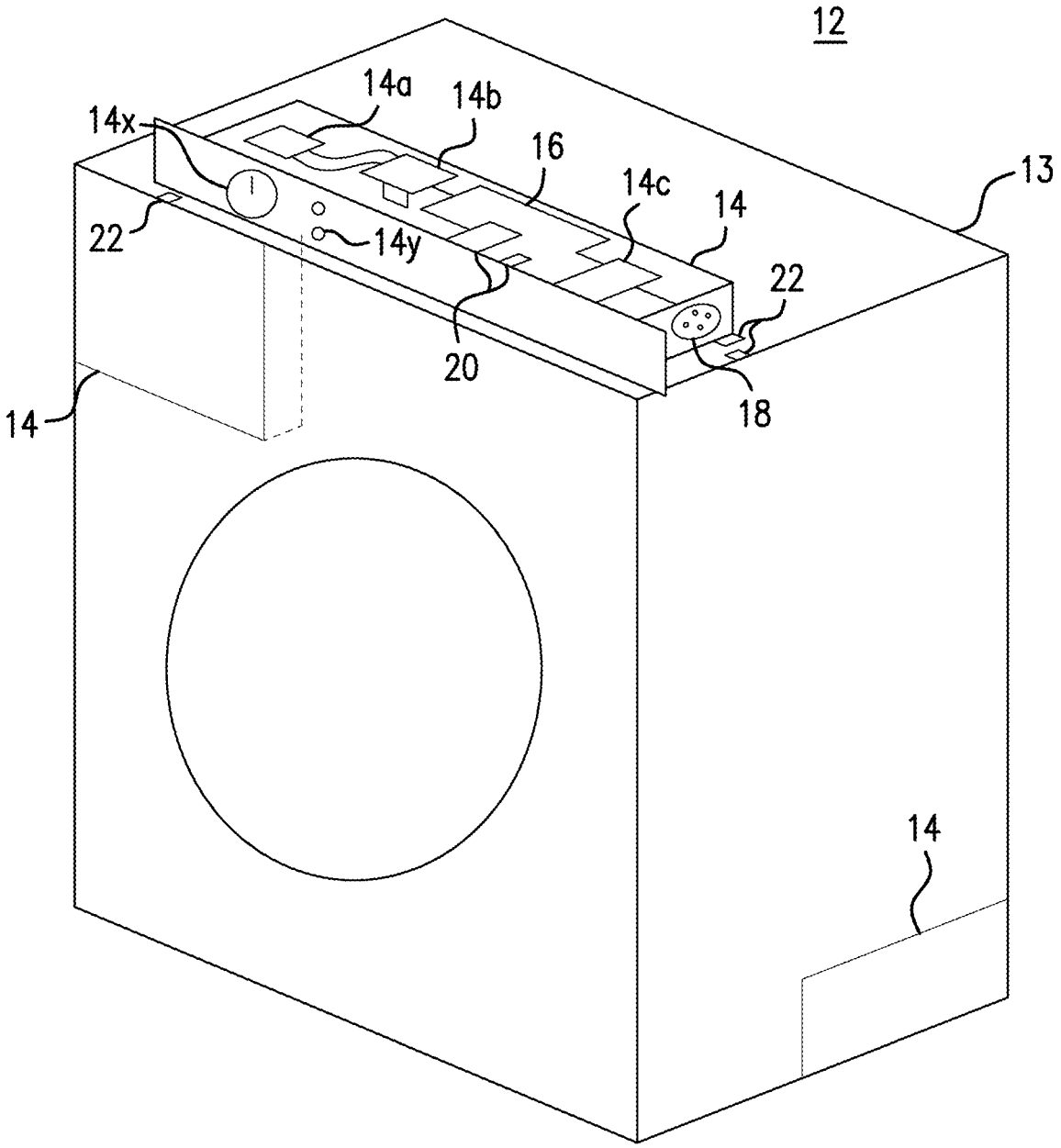
FIG. 1 is an illustration of a modular manufacture.

The figures and descriptions provided herein may have been simplified to illustrate aspects that are relevant for a clear understanding of the herein described apparatuses, systems, and methods, while eliminating, for the purpose of clarity, other aspects that may be found in typical similar devices, systems, and methods. Those of ordinary skill may thus recognize that other elements and/or operations may be desirable and/or necessary to implement the devices, systems, and methods described herein. But because such elements and operations are known in the art, and because they do not facilitate a better understanding of the present disclosure, for the sake of brevity a discussion of such elements and operations may not be provided herein. However, the present disclosure is deemed to nevertheless include all such elements, variations, and modifications to the described aspects that would be known to those of ordinary skill in the art.

Embodiments are provided throughout so that this disclosure is sufficiently thorough and fully conveys the scope of the disclosed embodiments to those who are skilled in the art. Numerous specific details are set forth, such as examples of specific components, devices, and methods, to provide a thorough understanding of embodiments of the present disclosure. Nevertheless, it will be apparent to those skilled in the art that certain specific disclosed details need not be employed, and that embodiments may be embodied in different forms. As such, the embodiments should not be construed to limit the scope of the disclosure. As referenced above, in some embodiments, well-known processes, well-known device structures, and well-known technologies may not be described in detail.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The steps, processes, and operations described herein are not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

When an element or layer is referred to as being "on", "engaged to", "connected to" or "coupled to" another element or layer, it may be directly on, engaged, connected or coupled to the other element or layer, or intervening elements or layers may be present, unless clearly indicated otherwise. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). Further, as used herein the term "and/or" includes any and all combinations of one or more of the associated listed items.

Yet further, although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the embodiments.

The embodiments provide a methodology whereby assembly time may be decreased for manufacturer of certain devices, such as large appliances, and particularly large cooking appliances such as ovens, stoves and cooktops, by a factor of ten or more over the known art. More particularly, the embodiments include the prefabrication, such as in the form of snap-in, screw-in or clip-in modules, of discrete portions or discrete device subsystems that may be common across all devices in certain locations in the device, for simplistic inclusion into the device during manufacture. The modular subsystem(s) may snap entirely onto one, or more than one, internal supports or fasteners already within the device shell. In certain instances, the device shell may comprise a cabinet, such as an oven cabinet, which may include certain standard hardware, such as power wiring, interior lights, and/or interior shelves.

Accordingly, one or more aspects of device manufacture may be automated, such as allowing for the use of robotics; minor variances between devices may be largely eliminated; manufacturing throughput and yield may be increased; and the efficiency and logistics of storage of manufactured appliances following manufacture may be improved. Advantageously, the foregoing allows for the modules to independently, discretely and conveniently provided to a manufacturing line. Moreover, the manufacturing line, at least due to the elimination of large variations in available throughput as occurs in the known art, may generate and store much of the necessary modular inventory offsite. Needless to say, quality control and inspection of the devices may also thus largely occur offsite, as the individual modules may be inspected for quality outside of the manufacturing line. This, of course, further enhances manufacturing throughput.

It will be appreciated that each of the foregoing aspects enhances throughput and yield as stated above. Further, it will be understood that the skilled artisan that repetitive motion injuries, cut injuries, other injuries, and job satisfaction may further be substantially addressed by the disclosed embodiments.

FIG. 1 illustrates a device 12 comprised of a plurality of snap in modules 14 during manufacture 10 of the device 12, which includes at least the device shell 13 suitable to receive module(s) 14. It should be noted that the embodiment of FIG. 1 is provided by way of example only, and any large device or appliance, such as an oven, having a plurality of subsystems may make use of the disclosed embodiments.

Each of the modules 14 illustrated in FIG. 1 may include numerous components 14*a, b, c* . . . brought together in the module 14. Further, each module 14 may include connectivity 16, 18 between components 14*a, b* . . . , and to external elements of the device, as needed, along with mounts 20 for the components 14*a, b* . . . to securely retain each component in its proper position within module 14, as well as external mounts 22 for the overall module 14 to be place into the device 12 during manufacture, also as needed.

Components may include, but are not limited to, appliance components. By way of example, a module 14 may include components of a front, rear, or embedded header of an oven, such as components including a human-machine interface (HMI), control unit(s), wireless or wired communication chipsets and components, wireharness(es), valves, hoses, stamped components, and so on. Accordingly, modules 14 may be mechanical, electrical, or electro-mechanical, either independently or in combinations thereof.

As shown, certain of the modules 14 may include not only internal components 14*a, b* . . . in order to provide operability to the module 14, but further may include external components 14*x, y, z* . . . such as dials, buttons, push-buttons (flat or raised), sensors (such as push-pressure sensors), lights, and so on. Using the device mounts 22 discussed above, each module 14 may be placed, manually or automatically, during the manufacturing process, at its proper location in the device 12, at which the securing mounts/fasteners 22 for that module 14 may be fastened into the device 12 to allow for operability of internal components 14*a, b* . . . and external components 14*x, y* . . . , as discussed throughout.

It would be understood that the manufacture of the device 12 in accordance with the illustration of FIG. 1 may free up floor space and limit storage needs in the manufacturing line 30, in the warehouse, in onsite storage, and so on, to thus enable more units to ship and with improved quality control.

By way of example, quality control 36 may be implemented at the formation site for each module 14, such that quality control 42 in the manufacturing line may be minimized, or quality control 42 in the manufacturing may simply provide redundancy with the quality control 36 done offsite, thereby improving yield, throughput, and product performance of the manufacturing line 30. Needless to say, the foregoing may also decrease cost to the manufacturing center, such as by minimizing inventory, decreasing inspection needs, decreasing labor needs, improving onsite logistics, and so on.

Moreover, module or modules 14 may be manufactured, shipped and/or sold from a particular site, while the shell 13 may be separately supplied. By way of example, a retail outlet may have a certain number of shells 13 available or on-hand that are operable with a variety of modules 14, such as may correspond to a hierarchical series of increasingly premium models for a particular appliance, such as an oven, all of which correspond to the same cabinet 13. Consequently, the retail outlet may inventory each of the hierarchical series of modules 14 in a certain amount, and may likewise inventory cabinet 13 to correspond to each sale of each module 14. Moreover, such as via online ordering, the foregoing allows for the manufacture of a single cabinet 13 type, and a shipping of that cabinet 13 to a site, and a separate shipping to the site of whatever module 14 corresponds to the ordered hierarchical model in the model series.

Figure 2:
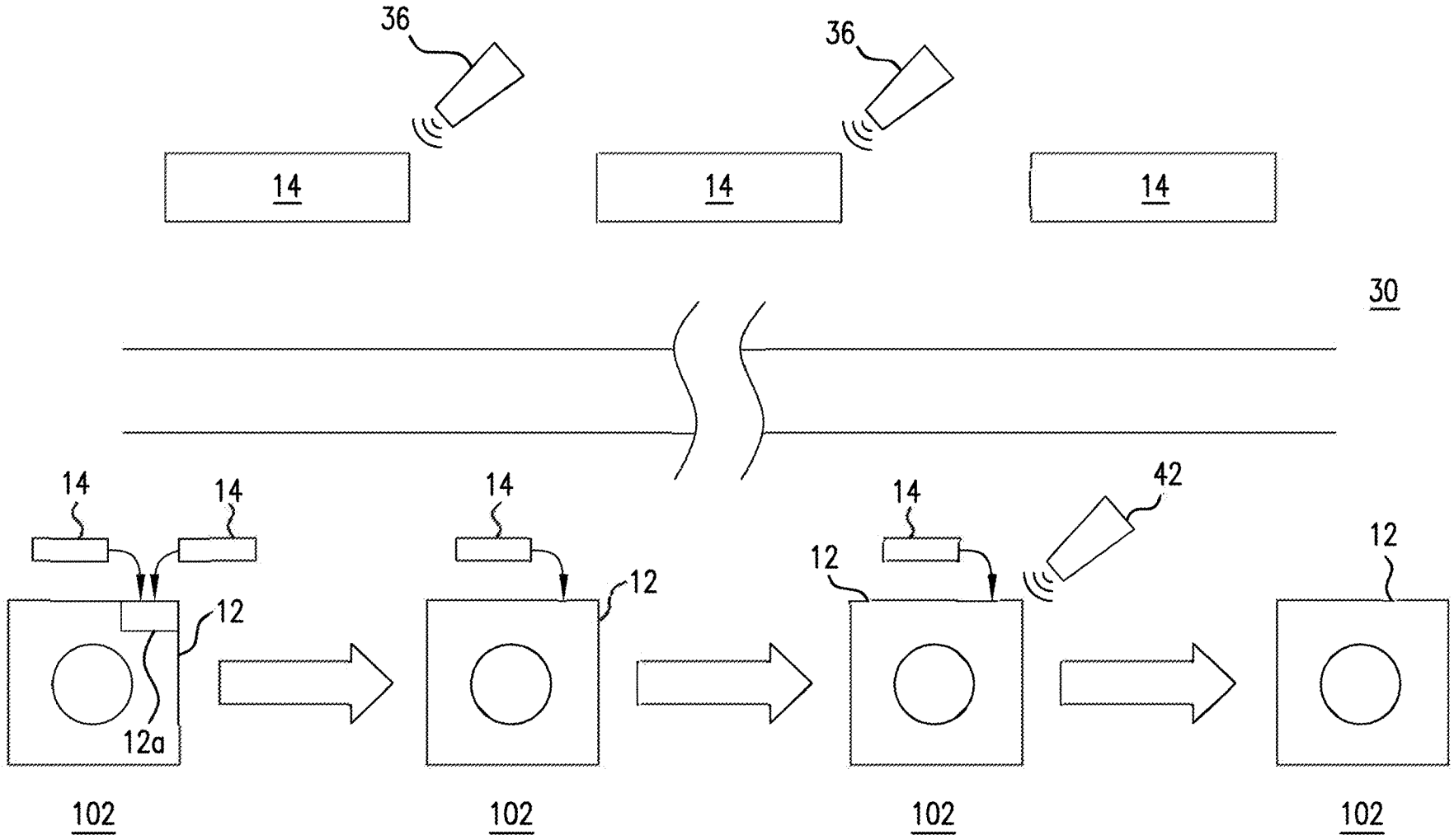
FIG. 2 is an illustration of a manufacturing system.

As illustrated in FIG. 2, the providing of a plurality of snap in modules 14 may or may further decrease the number of stations 102 necessary in a manufacturing line 30. For example, rather than a manufacturing employee 104 working on only one aspect of the device 12 before the device 12 is passed to the next station 102, each station 102 may allow for the installation of one or multiple snap-in modules 14, such as wherein all snap in modules 14 in a particular portion of the device 12*a* are ergonomically installed at a single manufacturing station 102.

By providing the disclosed snap in modules, and such as in any embodiments wherein one or more modules in a particular aspect of the device are substantially simultaneously installed at a single station, station ergonomics may be improved as referenced above. By way of example, the need for an unnatural angle for installation of an aspect may be largely eliminated in the embodiments, because modules may be formed particularly to follow angles of a device shell for installation, and/or may be automatically installed. Further, the attachment of the module within the device may be readily rotatable and munipulatable to comply with principles of z axis and/or neutral plan manufacturing, thereby improving employee health and return on investment.

Moreover, as the attachment of the many components within the module, and/or of the one or more modules to the cabinet, may be performed outside of the manufacturer line, the number of aspects in need of attachment to the device during manufacturer is greatly minimized. That is, in embodiments where 20 components were necessary for attachment individually across multiple stations in the manufacturing line in the known art, the embodiments may provide a single module inclusive of all 20 components, thereby requiring the attachment of only a single component, i.e. the module, at a single station in the manufacturing line. Further, each module may be designed to more readily allow access to components, such as for replacement of low yield or faulty components, or for later replacement of use-failed components, due to the design of the module independently from the design of the overall device.

Further, and as referenced above, the integration of modules into a manufacturing system allows for improved correction of defects over the known art. Indeed, quality control at the module formation site allows for the correction of most defects prior to arrival of the module at the manufacturer's facility. Accordingly, the embodiments may significantly improve manufacturing line yield over the known art. That is, in the known art, even the least stringent of quality control systems generally performs quality control at at least several stations during the manufacturing line, and additional testing at the end of device production. Needless to say, this enhances the likelihood that defects will enter the manufacturing process, such as between inspection stations or in the overall operations across a variety of stations each performing their respective functionality.

Figure 3:
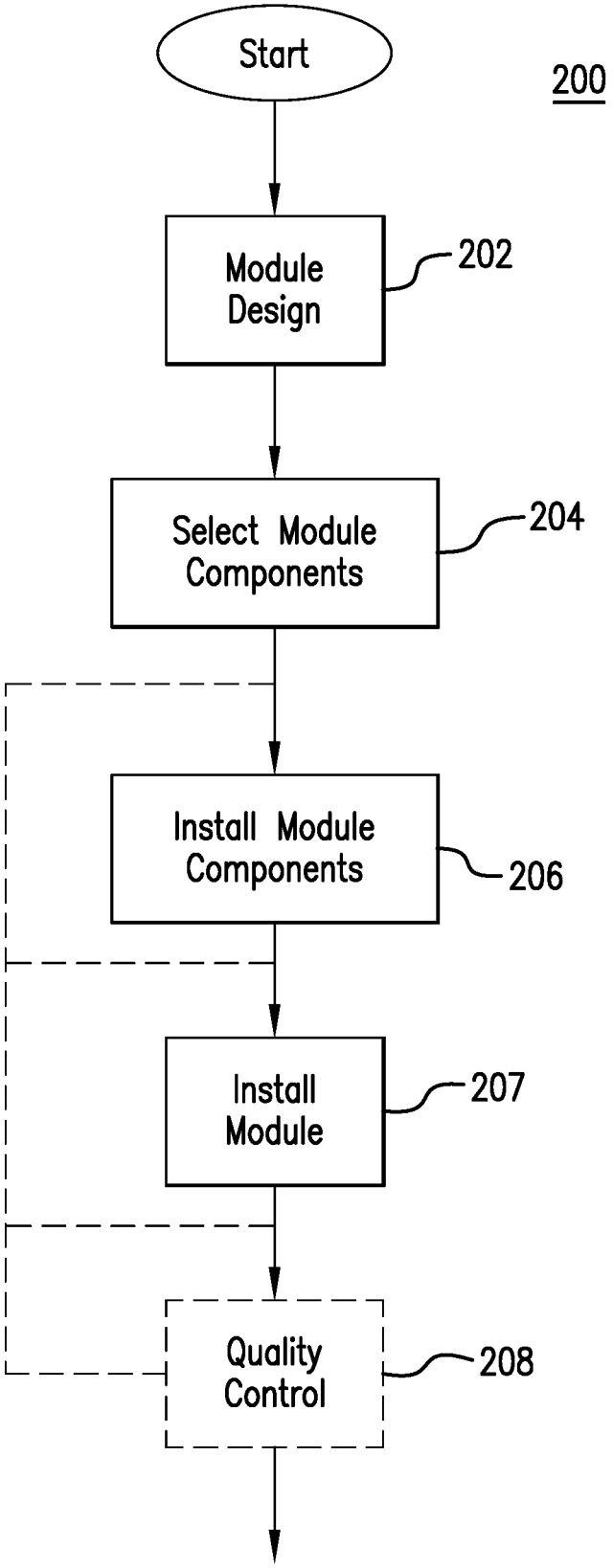
FIG. 3 illustrates a manufacturing method.

FIG. 3 illustrates a flow diagram of a method 200 according to aspects of the embodiments. As illustrated, a plurality of modules is designed to perform, often in conjunction with other modules, functionality provided by a device, at step 202. Further, each of these modules is designed to be located within that device, such as within at least internal portions of the device, and/or, at times, with external portions of the device, at step 202.

At the next step 204, a variety of components necessary to perform the functionality of a given module are selected for placement on the module. Each of these components may thus be provided with a fastener, a location, and any other aspect necessary to perform the functionality and/or fastening of the component within the module, such as wiring, connective traces, soldering, and the like. These components are then placed, fastened, physically and/or electrically connected, at their respective locations on the module, at step 206. The module is thus provided with external fasteners to ultimately allow for placement of the module into the device and/or interconnection with other modules at step 206.

Each module is preferably placed into the overall device at its designed/designated location. This placement into the overall device at step 207 may be done manually, robotically, or in combinations thereof, by way of non-limiting example.

Yet further, the method discussed above with respect to FIG. 3 may additionally include optional steps 208 for quality control inspection, such as upon placement of one or more components into the module, placement of the module into the device, placement of other modules in the device in conjunction with the module, or upon completion of production for the final device. Needless to say, based on the present disclosure, aspects of this step 208 may be performed in different locations, such as at the module generator and at the manufacturer.

Figure 4A:
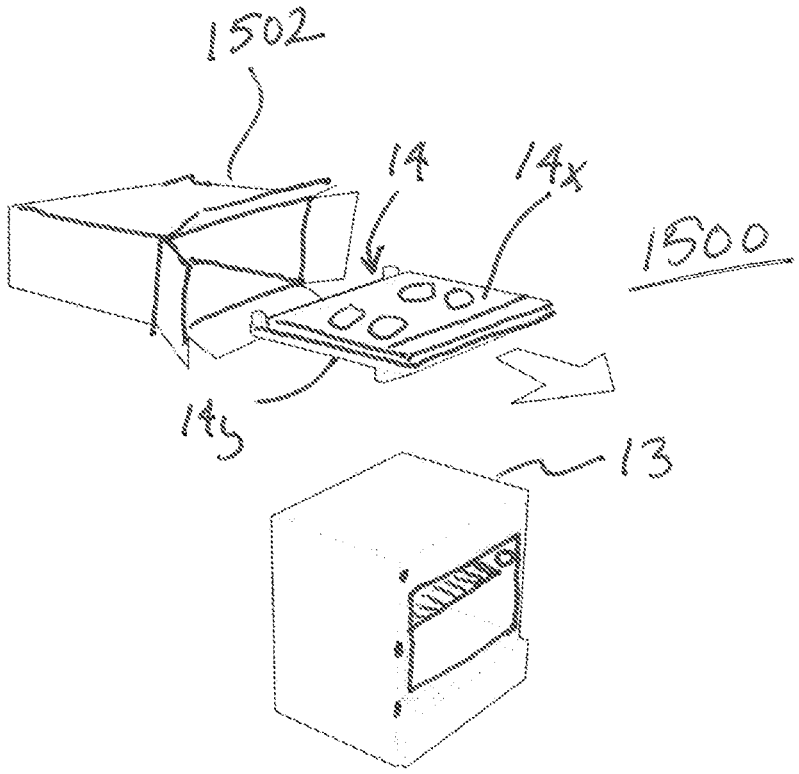
FIG. 4A illustrates aspects of the embodiments.

FIG. 4A illustrates a cabinet 13 suitable for providing a stove/range 1500, i.e., a combination oven and cooktop, for residential or commercial use; and, separately from the cabinet, a cooktop 14*x* and stove front 14*y* modular assembly 14. As shown, the modular assembly 14 may be separately provided, such as being separately boxed from, the cabinet 13, and may be removed from separate packaging 1502 for association with the cabinet 13, such as upon receipt at a manufacturing facility, upon receipt at a retail establishment, upon receipt at a commercial or residential location, or the like.

Figure 4B:
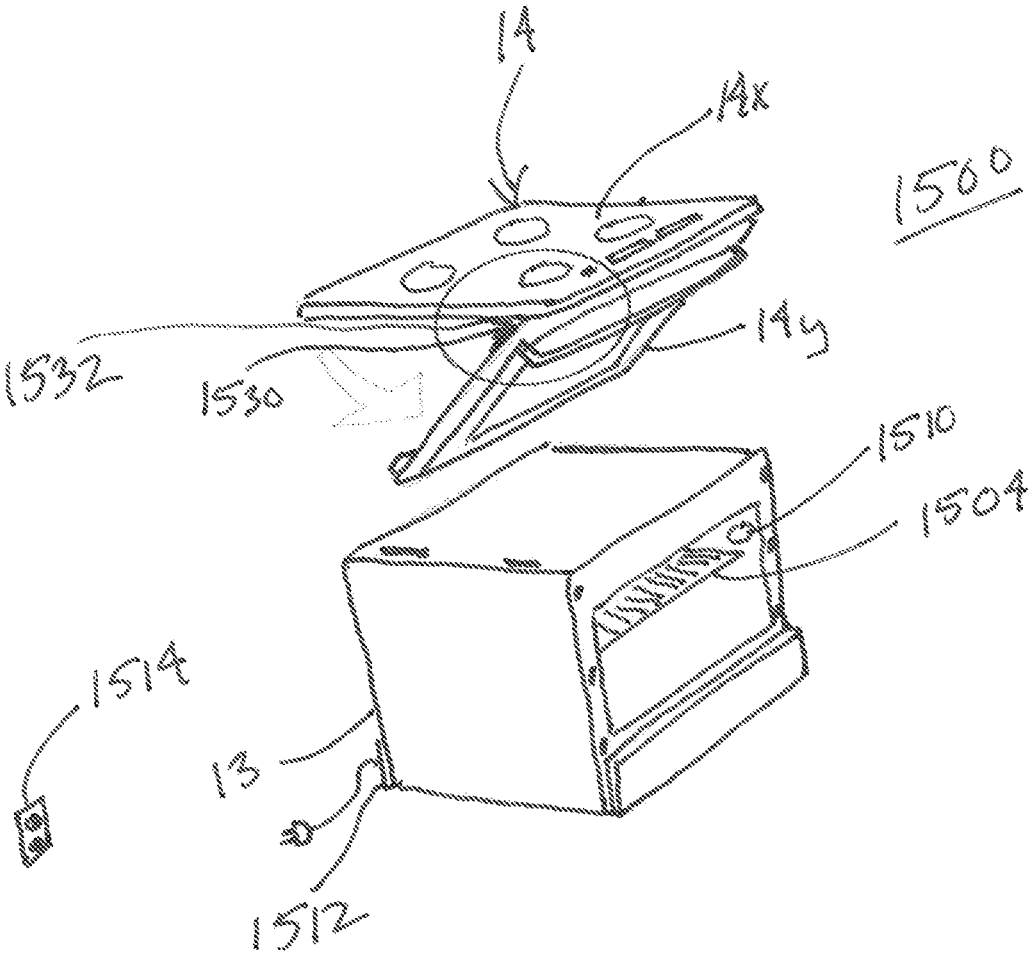
FIG. 4B illustrates aspects of the embodiments.

FIG. 4B illustrates an initial step, after removal of the modular assembly 14 from its packaging 1502, of the range module 14 with its associated cabinet 13. As illustrated, the cabinet 13 may include those "generic" items typical of a range, such as racks or shelving 1504 within the stove 1500, interior lighting 1510 for the inner portion of the stove 1500, and a plug and/or power wire harness assembly 1512 capable of association with outlet power 1514 such that power may be provided to the stove cabinet 13 and the module 14 upon association with the cabinet 13. Those skilled in the art will, of course, appreciate that a utility power plug and a power wire harness 1512 may alternatively be associated with the modular portion 14 of the range 1500, such that, upon association of the modular portion 14 with the cabinet 13, power is provided to the cabinet 13. Nevertheless, in either case the cabinet portion 13 may serve as a "dummy" portion of the range 1500, and as such may be standard across multiple models of a given manufacturer's ranges, or across models from different manufacturers.

As is additionally illustrated in FIG. 4B, the modular assembly 14 may be provided with one or more hinges 1530, such that the cooktop 14*x* and range front 14*y* may be compactly folded, and/or may be unfolded to approximately a right angle, for association of the module assembly 14 with the cabinet 13. Of note, this hinge 1530 (or these hinges) may be of any type known to the skilled artisan, and may be one time use or multiuse hinges. As such, the hinging 1530 of the stove module 14 may include a multi-position locking mechanism 1532, such as may lock the module 14 in the compactly folded position and/or in the open position for association with the cabinet 13.

Figure 4C:
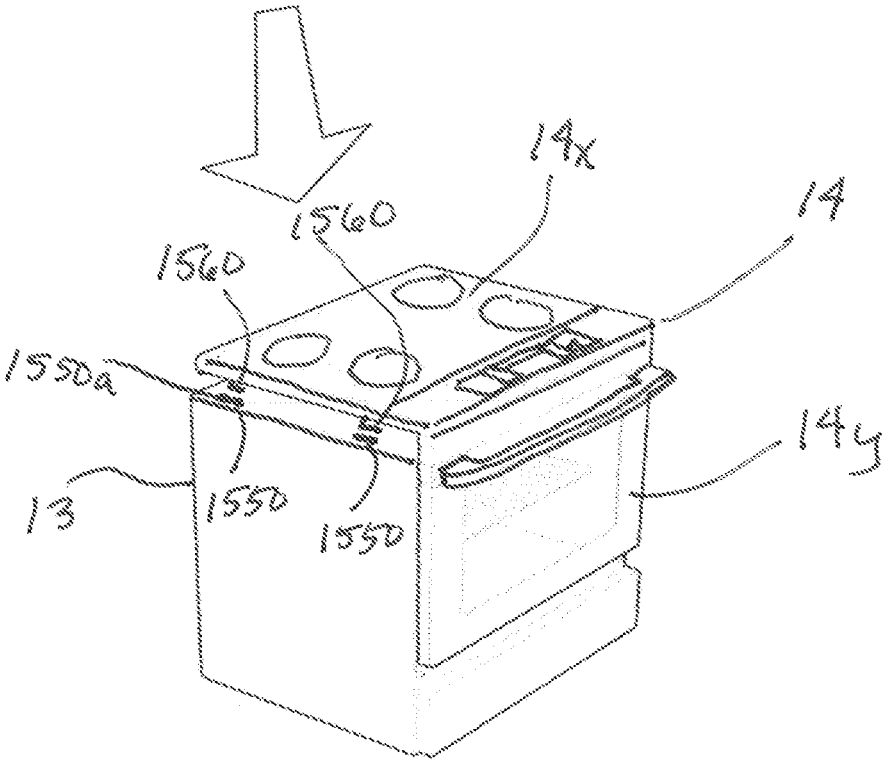
FIG. 4C illustrates aspects of the embodiments.

Association of the module 14 with the cabinet 13 is illustrated in FIG. 4C. Of note, latching positions 1550 are shown on the cabinet 13 in FIG. 4C, which latching positions 1550 may comprise female openings 1550*a* suitable for receiving a male locking mechanism 1560 on the module 14 upon association of the cooktop portion 14*x* of the module 14 with the upper portion of the cabinet 13 at the locking positions. These locking mechanisms 1550*a*/1560 may comprise any locking system known to the skilled artisan, such as but not limited to a spring lock that firmly grasps the male portion (and/or a clip or tab thereon) 1560 on the bottom side of the cooktop module 14*x* into the female portion 1550*a* of the locking position 1550 on the cabinet 13 upon placement of the cooktop 13 in the proper location atop the cabinet 13. These locking positions 1550 may be of any location or number suitable to receive a mated locking portion of the cooktop 14*x* therein or thereon, and as such the locking positions 1550 may be female as discussed throughout, or may be male on the cabinet 13 and female on the underside of the cooktop 14*x*, by way of non-limiting example.

Figure 4D:
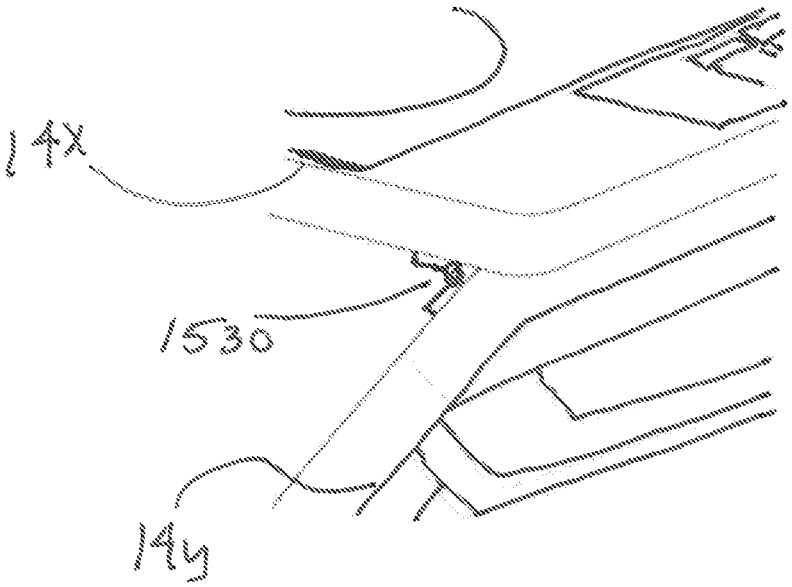
FIG. 4D illustrates aspects of the embodiments.

FIG. 4D illustrates with greater particularity the hinge 1530 present between the range front 14*y* and the cooktop 14*x*. Of note, the hinge 1530 in FIG. 4D is illustrated at an outermost portion of the stove module 14, such that maximum stability is provided as between the cooktop portion 14*x* of the module and the stove front portion 14*y* of the module during the folding and unfolding process.

Figure 5A:
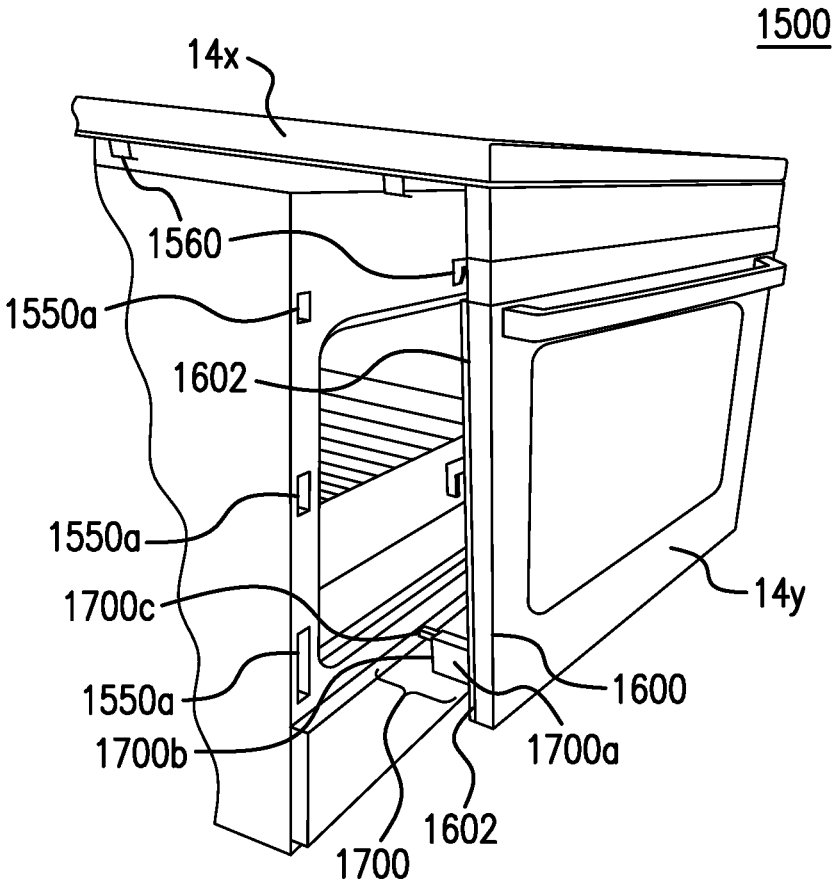
FIG. 5A illustrates aspects of the embodiments.

FIG. 5A illustrates with greater particularity an unfolded cooktop module 14*x* in the process of association with the stove cabinet 13. As shown, the stove module 14 may include multiple latching points 1560, such as male hooks for association with a female eye portion/latch location 1550 on the cabinet 13 and or tabs that spring lock into female portions, for association with both the top and front side of the cabinet 13 upon unfolding of the stove module 14. Further illustrated as an aspect of the stove 1500 in FIG. 5A is an oven door 1600 associated with the stove front portion of the front module 14*y*. This oven door 1600 may open outward from the stove 1500, and as such may form a distinct portion of the stove front module 14*y* that nests snugly within an outer frame portion 1602 of the stove front module 14*y* to thereby allow for opening and closing of the oven door 1600 in conjunction with suitable latching of the outer frame portion 1602 of the stove front module 14*y* to the front of the cabinet 13.

Figure 5B:
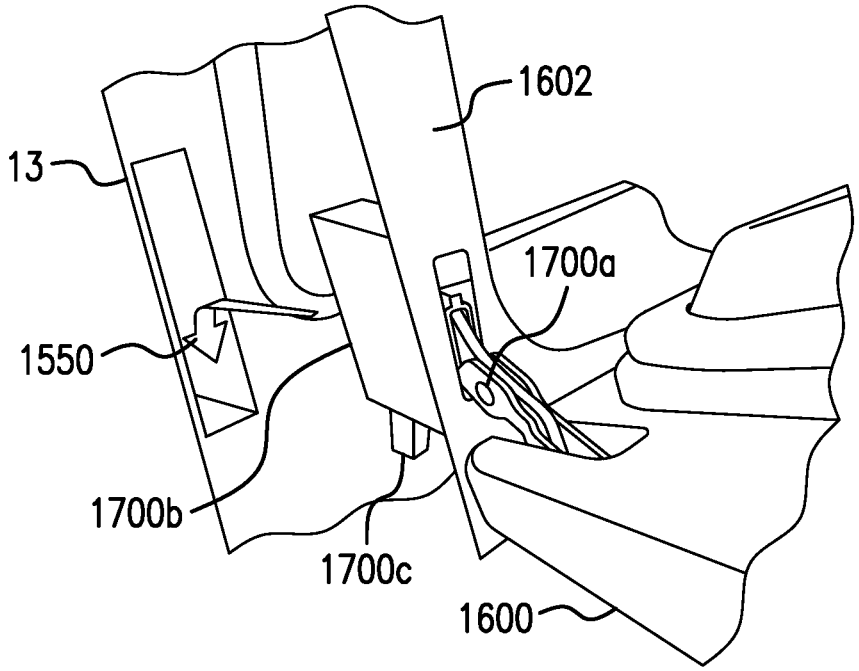
FIG. 5B illustrates aspects of the embodiments.
Figure 5C:
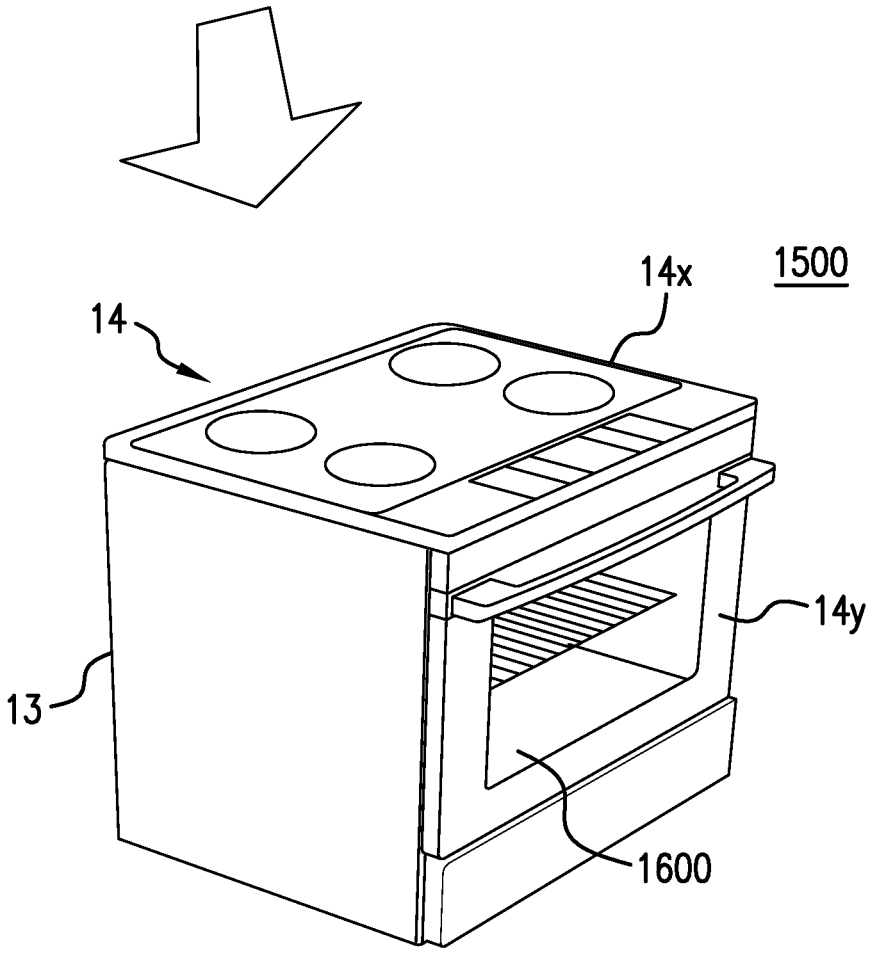
FIG. 5C illustrates aspects of the embodiments.

Also shown in FIG. 5A is a hinge portion 1700 that allows for the opening of the oven door 1600 once the oven door 1600 and the stove front module 14*y* are latched into the cabinet 13. FIG. 5B illustrates this aspect of the embodiments with greater particularity. Of note, a hinge 1700*a* for the oven door 1600 is suitably connected to the oven door 1600 and passes into and through the frame portion 1602 of the stove front module portion 14*y*. This extension through the frame 1602 includes an accommodation feature 1700*b* for the hinge portion 1700*a* on the cabinet side of the frame 1602, and may additionally include, on or extendable from (such as via a spring) this accommodation portion 1700*b*, a latching feature 1700*c* for mating between the latching feature 1700*c* of the hinge accommodation portion 1700*b* and a latching position 1550 on the cabinet 13. Simply put, the cabinet 13 may thus receive the hinge 1700 into an open position 1550 on the cabinet 13, and may receive a latching of that hinge 1700, and thus also of the frame 1602 through which the hinge 1700 passes, to attach the over door 1600 and frame to the cabinet while also allowing the oven door 1600 to open and close in conjunction with actuation of the hinge 1700. The fully assembled stove 1500 is illustrated in FIG. 5C.

Figure 6A:
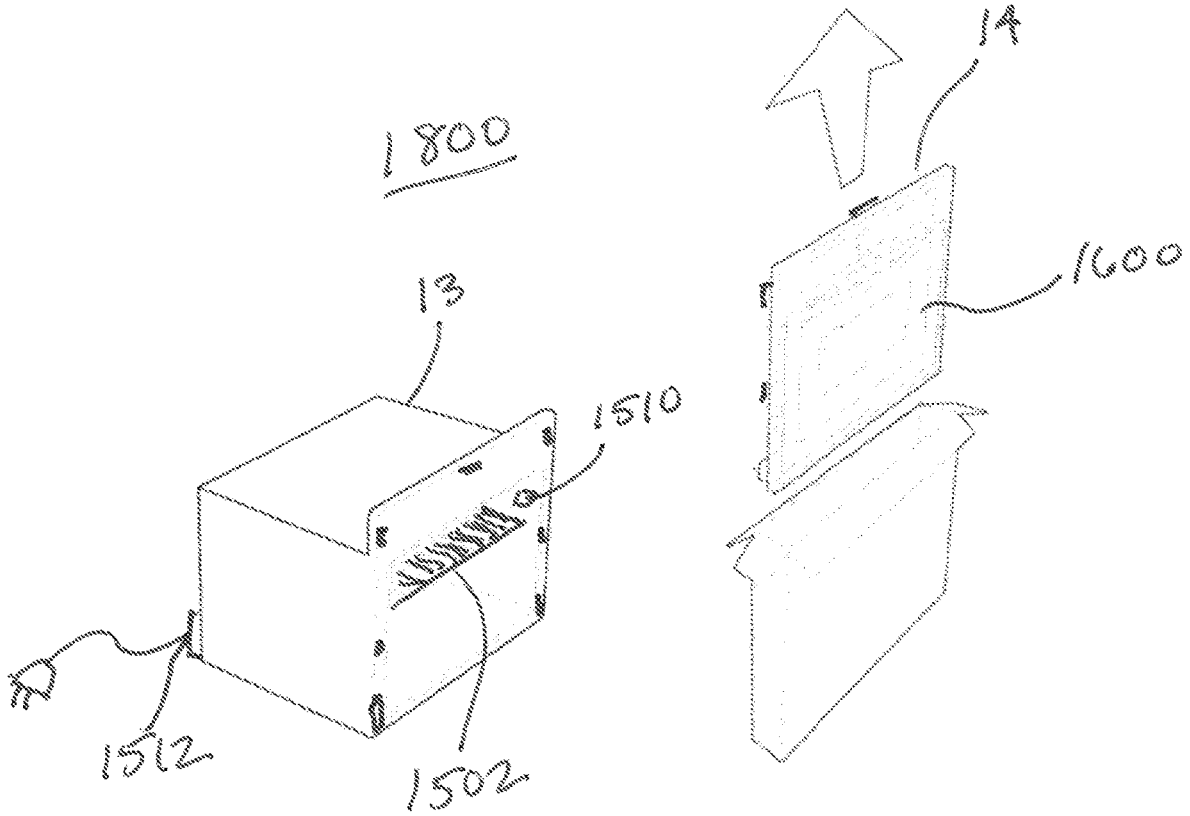
FIG. 6A illustrates aspects of the embodiments.

In an embodiment similar to those illustrated above in FIGS. 4 and 5, FIG. 6 illustrate a modular oven 1800 with an opening door 1600 and having an oven cabinet 13 capable of insertion into, for example, a receiving alcove in a residential or commercial wall in which the oven 1800 is to operate. As shown in FIG. 6A, the oven front module 14 may be provided separately from the oven cabinet 13, and the oven cabinet 13 may again include features typical in an oven, such as shelves/racks 1502, power, a power wire harness 1512, and one or more lights 1510.

Figure 6B:
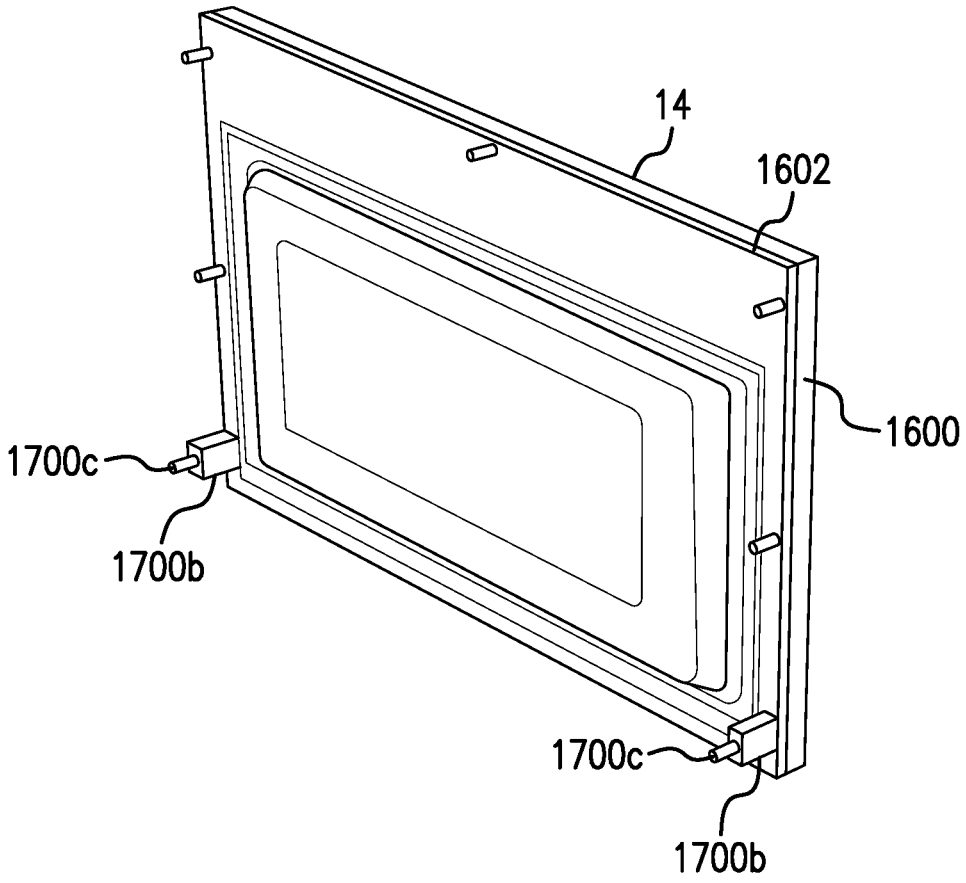
FIG. 6B illustrates aspects of the embodiments.
Figure 6C:
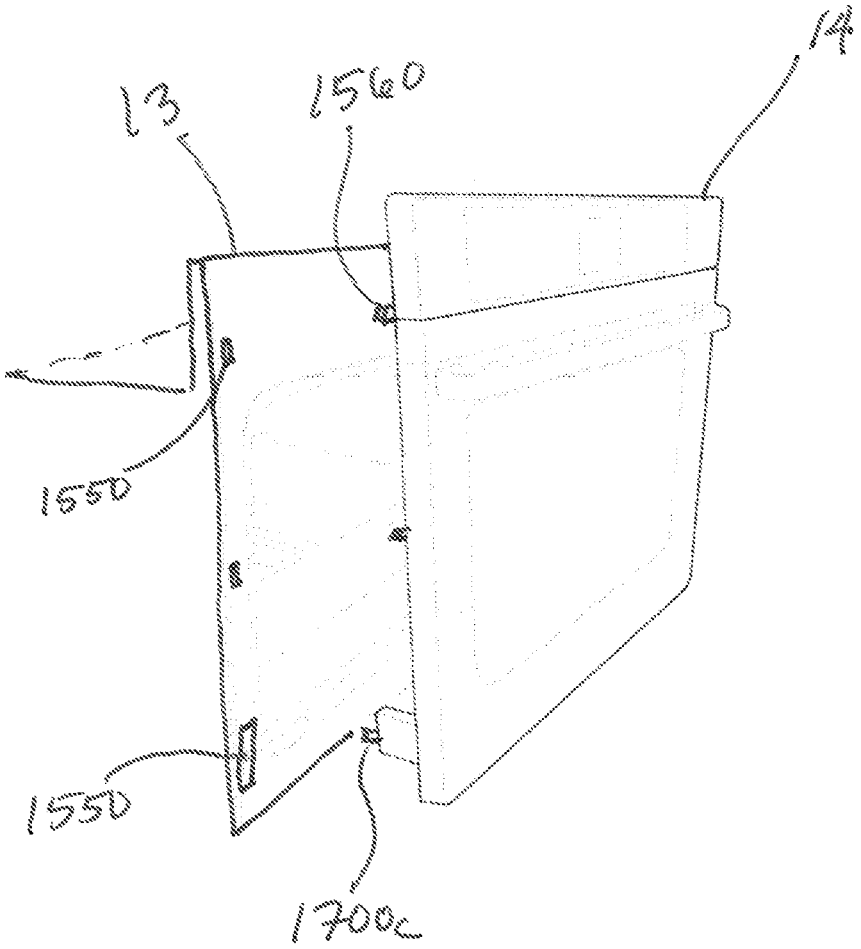
FIG. 6C illustrates aspects of the embodiments.

FIG. 6B provides a rearview of the oven front module 14 from the cabinet side. As illustrated, a frame 1602 is provided with a hinge accommodation 1700*b* and a plurality of mating latches. On the side of the frame 1602 opposite the cabinet 13 is provided an oven door 1600 associated with said hinge(s) 1700. FIG. 6C again illustrates the insertion of the latches 1560, including a latch/clip 1700*c* associated with the hinge accommodation 1700*b*, into the cabinet 13 for the oven.

Figure 6D:
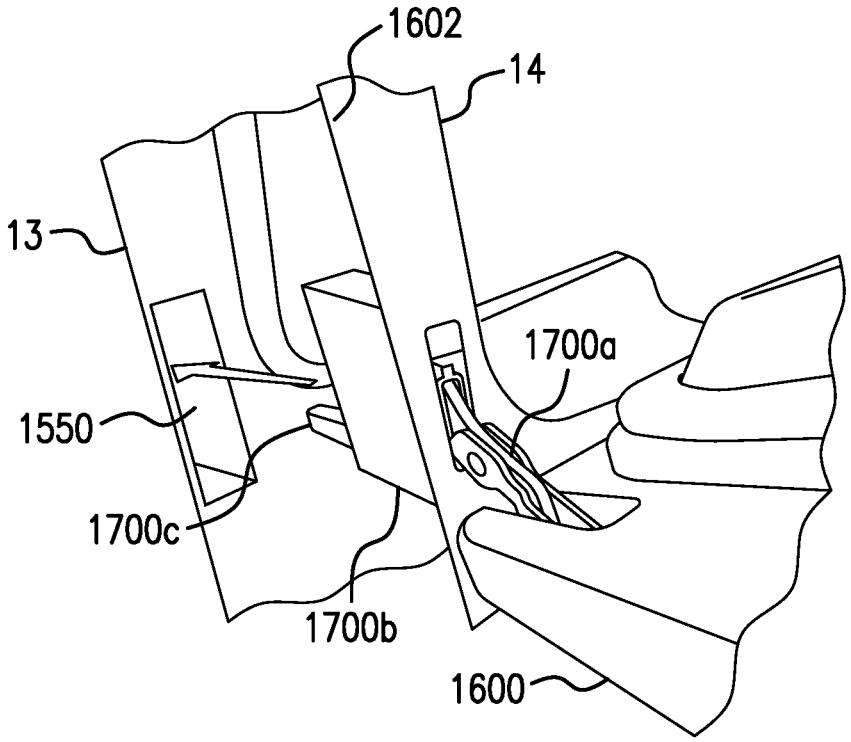
FIG. 6D illustrates aspects of the embodiments.

FIG. 6D illustrates with greater particularity the association of the hinge accommodation 1700*b*, having a latching portion 1700*c* thereof, into a receiving portion 1550 of the cabinet 13 such that the hinge 1700*a* is accommodated to allow for opening of the oven front door 1600 on the opposing side of the frame 1602. Of note, a comparison of FIG. 6D and FIG. 5B illustrates that, for different cooking appliances, the latching feature 1700*c* associated with the hinge accommodation 1700*b* may be placed in different positions, such as to account for the most suitable latching in light of gravity or for other reasons. For example, the latch/clip 1700*c* of FIG. 6D extends along the horizontal plane, while the latch/clip 1700*c* of FIG. 5B extends along a vertical plane.

Figure 6E:
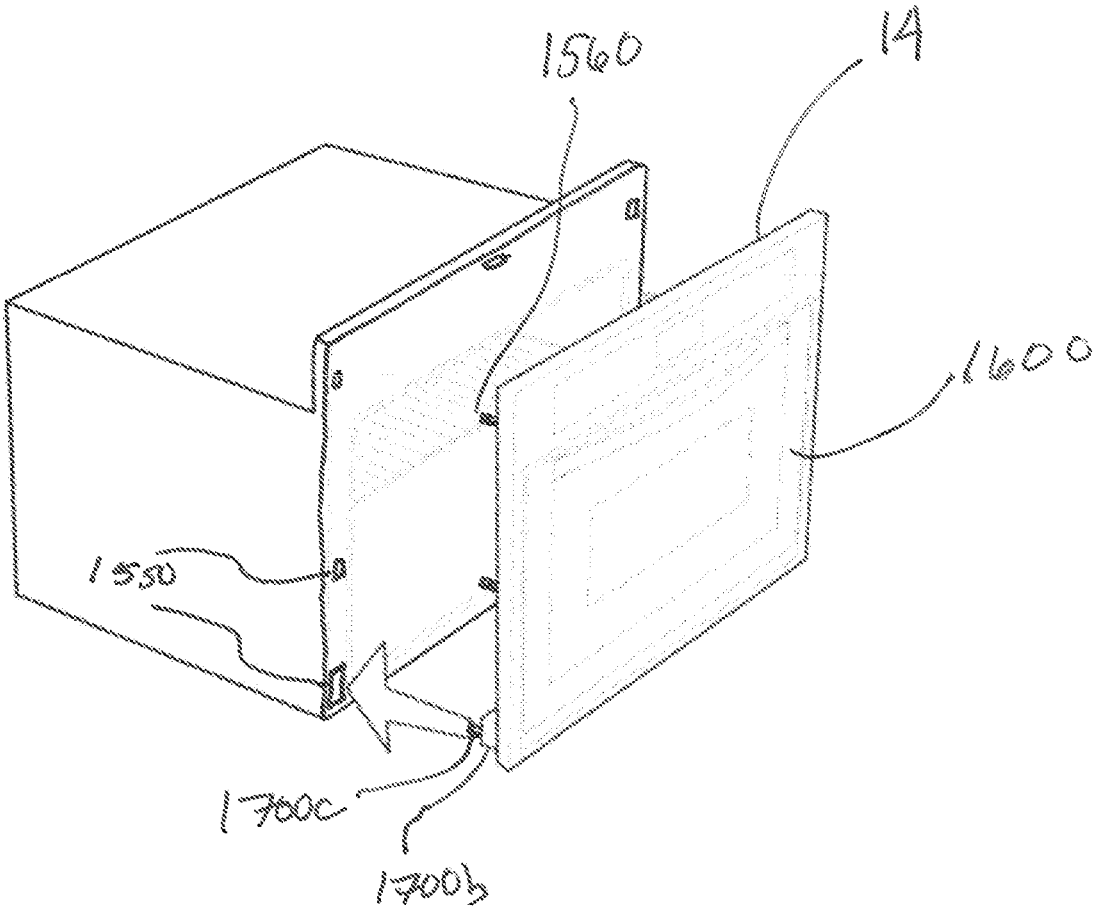
FIG. 6E illustrates aspects of the embodiments.
Figure 6F:
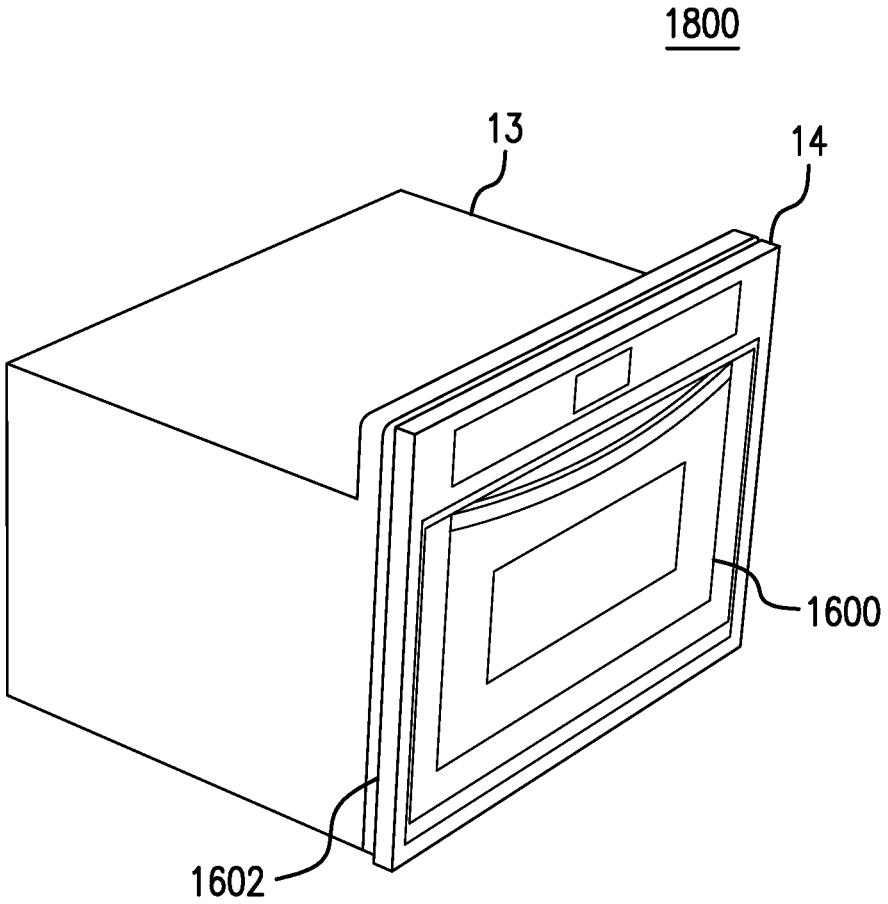
FIG. 6F illustrates aspects of the embodiments.

FIG. 6E illustrates the insertion of the oven module 14 having the frame 1602 and the hinged oven door 1600 into the generic oven cabinet 13. As shown, numerous latches, such as including the latch on the hinge accommodation as discussed throughout, may latch into the cabinet to provide a finished oven. This finished oven 1800 is illustrated in FIG. 6F.

It will thus be understood in light of the embodiments discussed with respect to FIGS. 4, 5 and 6 that the modular portion of the cooking appliance may include the "brains" of the appliance. That is, any manual or electronic actuators, electronic heating elements, software and firmware, LED or similar lighting, user alerts or messaging, and the like may be provided in association with the module rather than with the cabinet. Accordingly, one or more of the latching positions discussed throughout may also include an electrical docking connection. That is, seating of the modules discussed throughout into the latching position may also seat on electrical docking connection that may provide electrical power and order electrical signaling as between the cabinet and the module once the electrical docking is executed.

Needless to say, and as discussed throughout, aspects of each module may include known features that allow for interoperability of modules with the overall device. Such features may include, by way of example, proprietary or publicly available electrical connectors, exterior wiring, insulation, bumpers, knobs, adjustments, and so on.

It is appreciated that any exemplary computing, processing and control is merely illustrative of a computing which may be used in the herein described systems and methods, and does not limit the implementation of the herein described systems and methods from having differing components and configurations. That is to say, the concepts described herein may be implemented in any of various environments using various components and configurations.

In the foregoing detailed description, it may be that various features are grouped together in individual embodiments for the purpose of brevity in the disclosure. This method of disclosure is not to be interpreted as reflecting an intention that any subsequently claimed embodiments require more features than are expressly recited.

Further, the descriptions of the disclosure are provided to enable any person skilled in the art to make or use the disclosed embodiments. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but rather is to be accorded the widest scope consistent with the principles and novel features disclosed herein.

What is claimed is:

1. A manufactured range, comprising: a generic device shell capable of providing at least a back, bottom and sides of the manufactured range, wherein the generic device shell comprises at least a power supplying wire harness and a plurality of female latching points on a top and a front thereof; a folding module comprising a cooktop suitable for forming a top of the manufactured stove, and an oven front hinged to the cooktop and suitable for forming a front of the manufactured stove, the oven front comprising at least an oven door fittedly associated with a frame and having a door hinge connected to the oven door and passing through the frame; and a plurality of male latches associated with the folding module, including at least one male latch associated with the portion of the door hinge that passes through the frame, each capable of latching into a corresponded one of the plurality of female latching points so as to, upon the latching, form a completed one of the manufactured stove, the folding module comprises a folded configuration and an unfolded configuration, wherein in the unfolded configuration, the folding module attaches to the generic device shell to form the cooktop and front of the manufactured range.

2. The range of claim 1, wherein the female latching points comprise internal slots for receiving the male latches.

3. The range of claim 1, wherein the male latches comprise clips.

4. The range of claim 1, wherein the male latches comprise springs.

5. The range of claim 1, wherein the generic device shell includes a light internal thereto and electrically communicative with the power wiring harness.

6. The range of claim 1, wherein the generic device shell includes at least one oven rack therein.

7. The range of claim 1, wherein the cooktop comprises a plurality of burners.

8. The range of claim 7, wherein the cooktop comprises 4 burners.

9. The range of claim 1, wherein the over door comprises a window therethrough.

10. The range of claim 1, wherein the door hinge comprises a recessed hinge accommodation as the portion passing through the frame, and wherein a hinge of the door hinge hinges into and out of the hinge accommodation.

11. The range of claim 10, wherein the at least one male latch associated with the door hinge extends vertically downward therefrom, and is attached to, the hinge accommodation.

12. The range of claim 1, further comprising a plurality of human machine interfaces on the folding module.

13. The range of claim 12, wherein the plurality of human machine interfaces comprises electrical connection to electrical connectors on ones of the male latches, and wherein, upon latching of the male latches comprising the electrical connectors to the female latching points, a continuous electrical circuit is completed from the human machine interfaces through the powered wiring harness.

14. A manufactured oven, comprising: a generic device shell capable of providing at least a back, top, bottom and sides of the manufactured oven, wherein the generic device shell comprises at least a power supplying wire harness and a plurality of female latching points on a front thereof; a modular oven front suitable for forming a front of the manufactured oven, the modular oven front comprising at least an oven door fittedly associated with a frame and hinged to the modular oven front and having a door hinge connected to the oven door and passing through the frame; and a plurality of male latches associated with the modular oven front, including at least one male latch associated with the portion of the door hinge that passes through the frame, each capable of latching into a corresponded one of the plurality of female latching points so as to, upon the latching, form a completed one of the manufactured oven, the modular oven front comprises a folded configuration and an unfolded configuration, wherein in the unfolded configuration, the modular oven front attaches to the generic device shell to form a cooktop and front of the manufactured range.

15. The oven of claim 14, wherein the female latching points comprise internal slots for receiving the male latches.

16. The oven of claim 14, wherein the male latches comprise clips.

17. The oven of claim 14, wherein the male latches comprise springs.

18. The oven of claim 14, wherein the door hinge comprises a recessed hinge accommodation as the portion passing through the frame, and wherein a hinge of the door hinge hinges into and out of the hinge accommodation.

19. The oven of claim 14, further comprising a plurality of human machine interfaces on the modular oven front.

20. The oven of claim 19, wherein the plurality of human machine interfaces comprises electrical connection to electrical connectors on ones of the male latches, and wherein, upon latching of the male latches comprising the electrical connectors to the female latching points, a continuous electrical circuit is completed from the human machine interfaces through the powered wiring harness.

* * * * *